United States Patent [19]

Takasugi

[11] Patent Number: 4,738,117

[45] Date of Patent: Apr. 19, 1988

[54] INSULATING APPARATUS

[75] Inventor: Mitsuo Takasugi, Kanagawa, Japan

[73] Assignee: Colpo Co., Ltd., Tokyo, Japan

[21] Appl. No.: 11,823

[22] Filed: Feb. 6, 1987

[30] Foreign Application Priority Data

Feb. 8, 1986 [JP] Japan ..... 61-26511

[51] Int. Cl.[4] ..... F25B 5/00; F25D 15/00

[52] U.S. Cl. ..... 62/200; 62/237; 62/448

[58] Field of Search ..... 62/200, 415, 186, 60, 62/448, 298, 299, 302, 237, 259.1, 261, 263; 165/918, 919; 236/51

[56] References Cited

U.S. PATENT DOCUMENTS

| | | | |
|---|---|---|---|
| 2,647,376 | 8/1953 | Carlsson | 62/237 |
| 2,968,933 | 1/1961 | Pfeifer et al. | 62/126 X |
| 3,166,916 | 1/1965 | Burrows | 62/237 |
| 3,545,223 | 12/1970 | Elland | 62/237 |
| 3,898,854 | 8/1975 | McSheehy et al. | 62/237 X |
| 4,323,110 | 4/1982 | Rubbright et al. | 62/237 X |

*Primary Examiner*—Harry B. Tanner

*Attorney, Agent, or Firm*—Browdy and Neimark

[57] ABSTRACT

An insulating apparatus for individually managing the temperatures of small containers to be delivered or stocked has containers and cooling units. The cooling unit has a rack for placing the container and cooling elements inserted into the containers. The cooling elements are operated by pressing selectively operable pressors of the container side by a remote switch of the cooling unit side. The cooling elements are independent at the respective containers to individually control the temperatures of the containers.

9 Claims, 11 Drawing Sheets

INSULATING APPARATUS

BACKGROUND OF THE INVENTION

1. Field of the Invention

The present invention relates to an insulating apparatus for goods to be kept cool, such as frozen goods, chilled goods held at about 0° C., cooled goods held at about 10° C., etc., used in case of keeping the goods in containers and delivering the goods to stores or general households or temporarily stocking the goods in such a manner that the containers are individually maintained cool and insulated.

2. Description of the Prior Art

Goods to be cooled can be generally categorized to three types of frozen, chilled and cooled as described above. To deliver the goods, the goods have been heretofore contained in containers made of foamed polystyrene together with dry ice, cold storage reagent or ice.

According to the above method, an ordinary delivery vehicle can carry the goods to be cooled together with other types of goods, but since the insulation enabling time of the container is short, such as 5 to 10 hours, the above-described containers are not adequate when the delivery takes a long time, such as a long distance delivery or a delivery route (through branches and several delivery centers) like a general delivery. In such a case, a refrigerator or a special insulating vehicle must be employed. According to this method, the equipment is expensive, and since an exclusive insulation vehicle is used, general goods cannot be carried together with the goods required to be maintained cool. Further, since the vehicle must make the trip even if the quantity of the goods to be cooled is small, the delivery costs are increased. In addition, since the refrigerator in the insulating vehicle is maintained at uniform temperature, the goods to be frozen, chilled and cooled, each requiring different storage temperatures, cannot be contained together. Moreover, when the insulating vehicle or the refrigerator is employed, the door is opened whenever the goods are delivered, and chilled gas is readily leaked.

SUMMARY OF THE INVENTION

A primary object of the present invention is to provide an insulating apparatus which contains goods to be cooled in small containers and which can carry the goods in the containers together with general goods in a delivery vehicle.

Another object of the present invention is to provide an insulating apparatus which can maintain goods cool for a long time and set different insulating temperatures at every different containers therein.

Still another object of the invention is to provide an insulating apparatus which can contribute to the communication of the goods to be cooled.

Other and further objects, features and advantages of the invention will appear more fully from the following description.

DETAILED DESCRIPTION OF THE PREFERRED EMBODIMENTS

Figure 1:
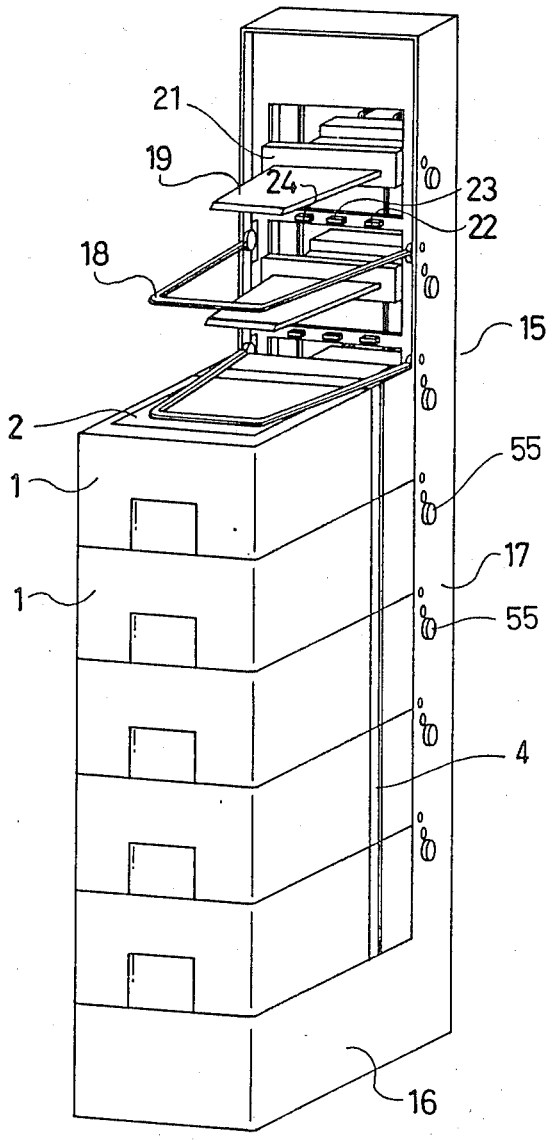
FIG. 1 is a perspective view of a preferable embodiment of an insulating apparatus according to the present invention.
Figure 2:
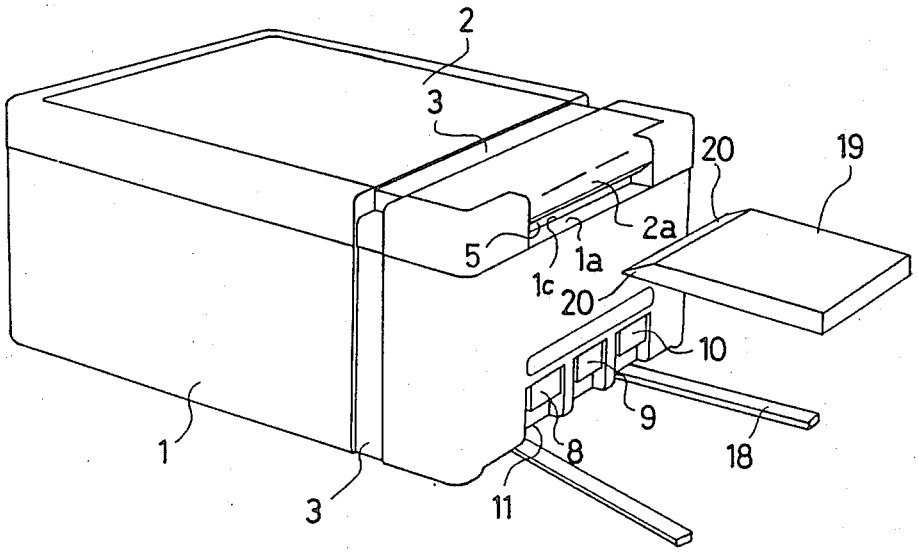
FIG. 2 is a perspective view showing an example of a container.
Figure 3A:
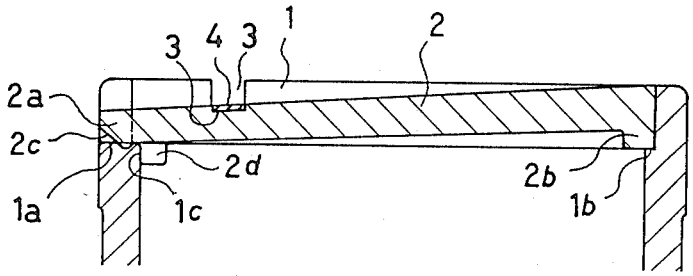
FIGS. 3A and 3B are longitudinal sectional views showing the internal structure of the container.

The most preferable embodiment of the present invention will be described in detail with reference to the accompanying drawings. The construction of a container used in the insulating apparatus of the invention will be first described. In FIGS. 1 through 3, a container 1 has a cover 2 and is made of foamed polystyrene. A shallow groove 3 is formed from the container 1 to the cover 2, and a rubber strip 4 is engaged in the groove 3. In FIG. 2, the strip 4 is not shown. The cover 2 is applied from above the upper surface of the container 1, and always pressed down by the strip 4. The front end 2*a* of the cover 2 is cut at both side corners in a square shape in the same width as an opening 5 formed by cutting the upper portion of the container 1 so that the cover 2 will fit in the opening 5. In FIG. 3A, a laterally long leg 2*b* is formed on the rear lower end of the cover 2. The leg 2*b* is placed together with the lower portion of the front end 2*a* of the cover 2 on laterally long stepped portions 1*b* and 1*a* formed on the upper inside and upper portions of the rear and front sides of the container 1. Thus, the cover 2 is pressed downwardly by the strip 4 engaged within the groove 3, to be usually tilted downwardly at the front side as shown in FIG. 3A. The lower side of the front end 2*a* of the cover 2 is obliquely cut to be formed with a claw inserting opening 2*c* to the upper end of the front portion of the container 1. A stopper 2*d* which is contacted with the upper edge 1*c* of the inside of the rear portion of the container 1 is formed as required at the front back surface side of the cover 2 inside the container 1.

Figure 4:
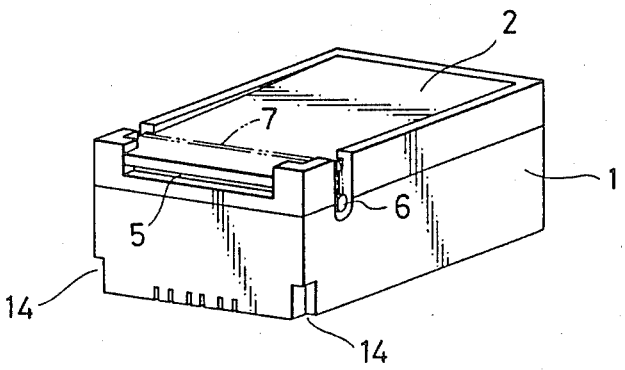
FIGS. 4 to 7 are views showing other examples of the structure of the container.
Figure 5:
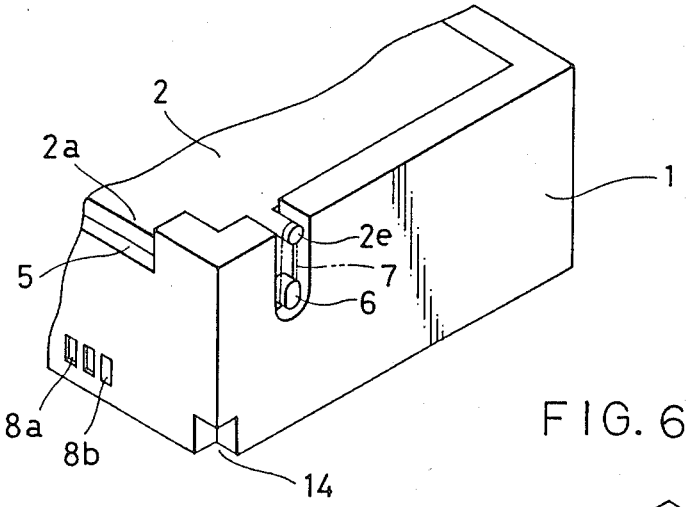

The rubber strip 4 is laterally engaged around the entire periphery of the container 1. In this case, as shown in FIG. 4, lateral projections 6 and 6 may be protruded laterally from both lateral outsides of the container 1, and a rubber ring 7 may be engaged between the projections 6 and 6 through the groove 3 of the cover 2. Or, as shown in FIG. 5, other projections 2*e* and 2*e* may similarly protrude laterally from both lateral outsides of the cover 2 together with the projections 6 and 6, and a rubber ring 7 may be engaged between the projections 2*e* and 6. Further, in case of a hard container made of a hard plastic, as shown in FIG.

Figure 3B:
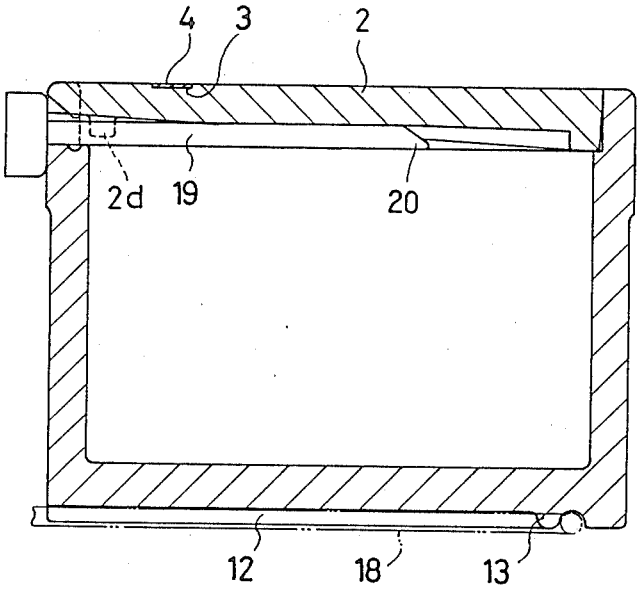
Figure 6:
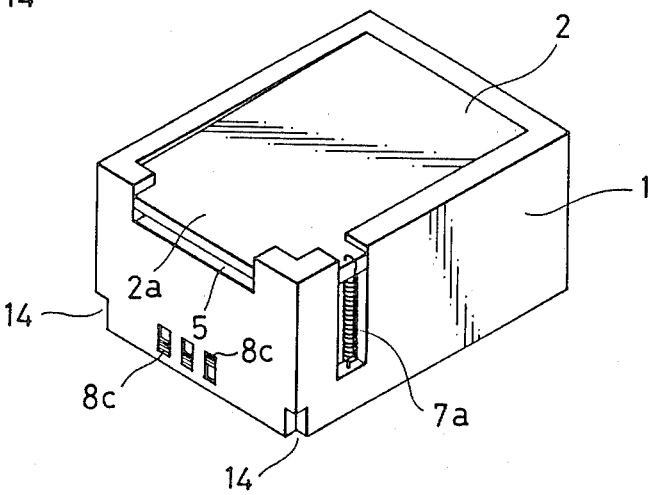
Figure 7:
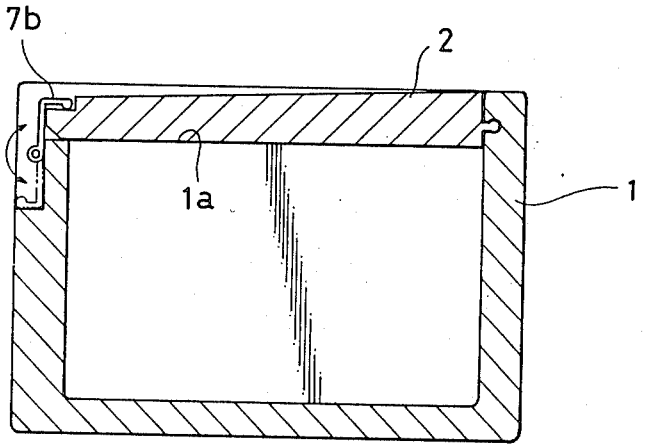

6, a spring 7*a* may be engaged between the cover 2 and the container 1. Moreover, the cover 2 may be retained by a hinged stopper 7*b* formed as shown in FIG. 7. Pressors 8, 9 and 10 are provided on the lower front surface of the container 1. For example, the pressors 8, 9 and 10 are corresponded to freezing, chilling and cooling zones of goods to be cooled. The pressors 8, 9 and 10 are respectively detachably installed in recesses 11 formed on the lower front surface of the container 1. To this end, the pressors 8, 9 and 10 are formed integrally with the container 1, for example, as clamped only at the upper portions of the pressors 8, 9 and 10. As another arrangement, it is considered that a plurality of recesses 8*a* are formed as shown in FIG. 5, fillers 8*b* are respectively inserted into the recesses 8*a* corresponding to the predetermined temperature zones (in the example in FIG. 5, the filler is inserted into the right side of the three recesses), or seals are bonded thereto. In case of the hard container, it is preferable that since the case is repeatedly used, a plurality of elevationally or laterally movable slide members 8*c* are provided in a slide type, and the slide members 8*c* corresponding to the predetermined temperature zone is moved in ON direction (FIG. 6). The number of the pressors is arbitrary, but one to five pressors are normally sufficient. A remote switch to be described later is operated by the pressors 8 to 10 to operate a refrigerating system. As shown in FIG. 3B, a recess 12 is formed on the bottom of the container 1, and a stopper 13 which extends laterally at the rear of the recess 12 is formed as required. The stopper 13 is used to retain a rack 18 to be described later.

Figure 8A:
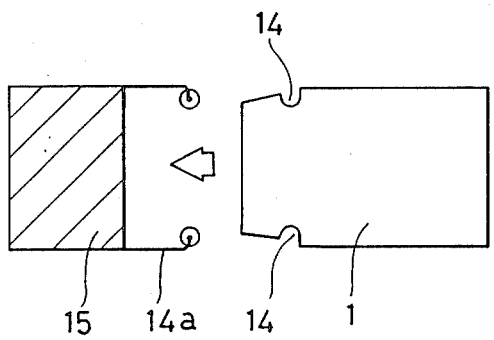
FIGS. 8A and 8B are views showing the displacing preventing method of the container.
Figure 8B:
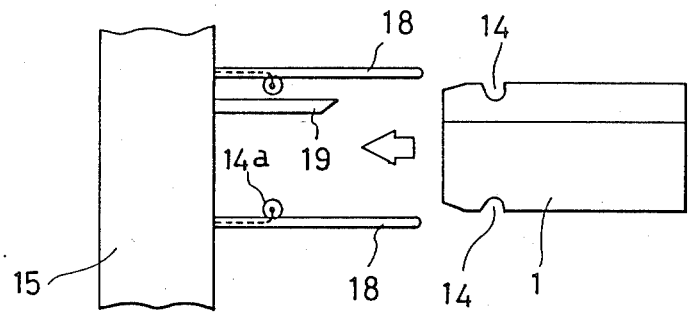

In FIGS. 4 to 6, engaging grooves 14 are formed at the both lower outer corners of the container 1, and stoppers 14*a* (see FIGS. 8A and 8B) which extend from a cooling unit 15 are engaged with the grooves 14 to prevent the container from displacing due to the fluctuation of a transport vehicle. The shape of the stoppers 14*a* are arbitrary, and the positions and the shapes of the grooves 14 may be altered correspondingly to the stoppers 14*a*. FIGS. 8A and 8B show examples of the grooves 14 and the stoppers 14*a*. In FIG. 8A, the bottoms of the containers are formed with the grooves 14 with which the stoppers 14*a* engage, and in FIG. 8B, which is oriented 90° with respect to FIG. 8A, the sides of the containers are formed with the grooves 14 with which the stoppers 14*a* engage.

Figure 9:
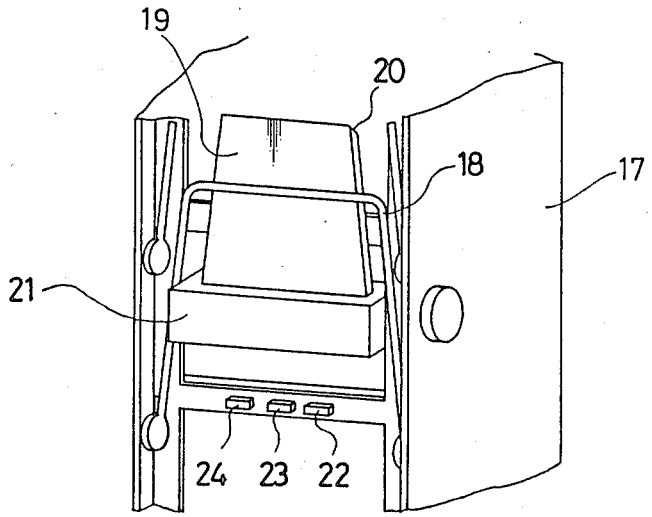
FIG. 9 is a view showing the folded state of a cooling plate and racks.
Figure 10:
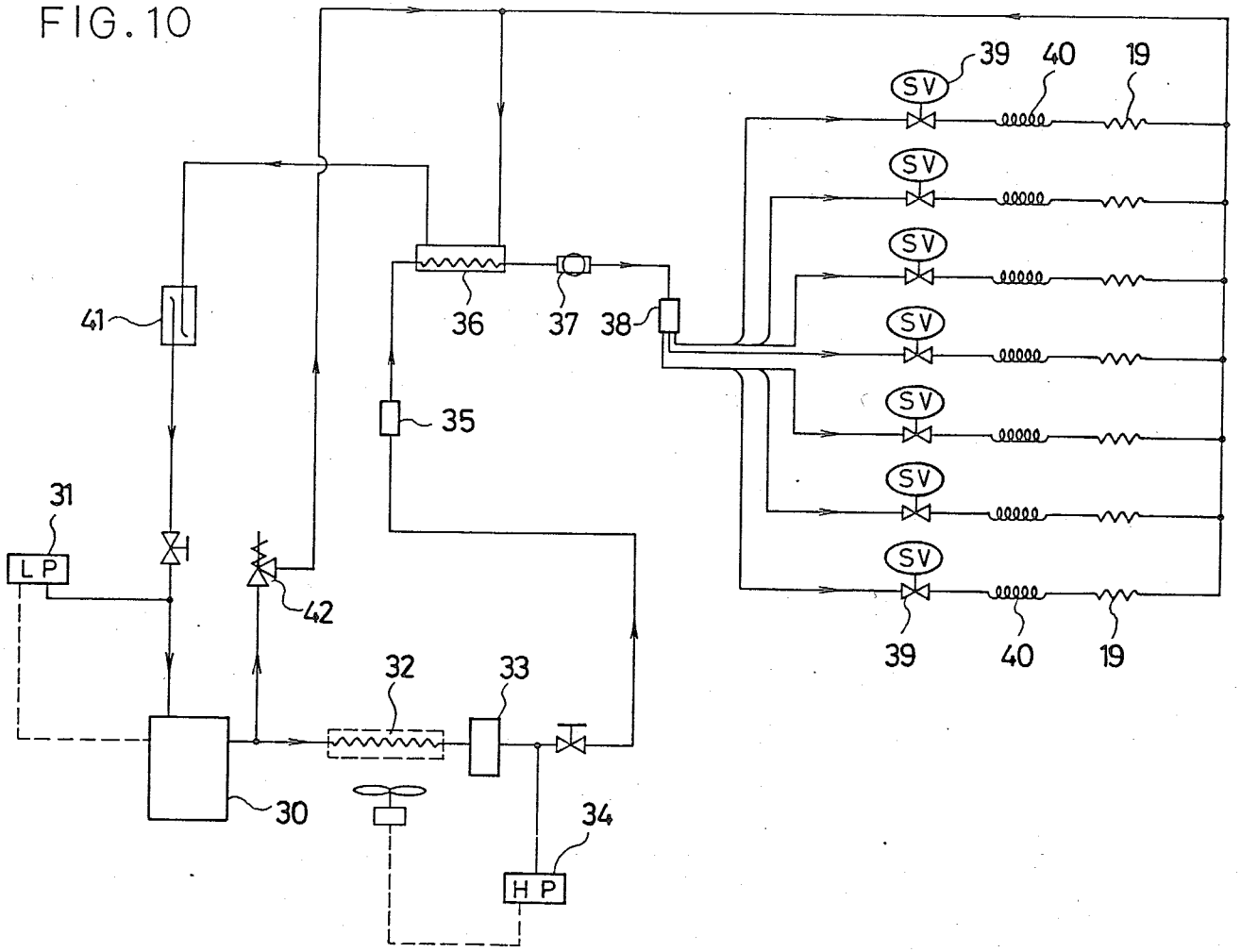
FIG. 10 is a piping system diagram of a refrigerating system.

The cooling unit 15 is associated with an ordinary refrigerating system which has a compressor, a condenser and a heat exchanger installed as shown in a base 16 in FIG. 1. FIG. 10 shows an example of a piping system diagram of the cooling unit. The cooling unit has a compressor 30, a low pressure switch 31 for starting and stopping the compressor 30, a condenser 32, a liquid reservoir 33, a pressure switch 34 for starting and stopping a condenser fan, a drier 35, a heat exchanger 36, a sight window glass 37, and a distributor 38. Refrigerant gas is distributed from the distributor 38 to cooling plates 19. The cooling unit also has a solenoid valve 39, a capillary tube 40, an accumulator 41 and a capacity regulating valve 42. The refrigerating system may be disconnected from the cooling unit. For example, when the insulating apparatus of the invention is installed in a deck of a delivery vehicle, the refrigerating system is mounted on a vehicle body as a separate unit, and the operating power is produced from a prime mover of the vehicle or from another independent prime mover. The cooling unit also has supporting walls 17 (see FIG. 1) at the side ends of the base 16 for installing a number of racks 18 at the same interval as the height of each container 1. Each rack 18 is sufficiently formed by bending a rod as shown in FIG. 1, but may be of plate shape. Each rack 18 is normally maintained horizontally with respect to the walls 17. The rack 18 may be formed pivotally upwardly as shown in FIG. 9 by pivotally securing the both side ends of the rack 18 to the walls 17. The cooling plate 19 is installed to be horizontal above each rack 18. The plate 19 is formed in a convergent plane shape converged to the end, and formed with a wedge-shaped claw 20 over the entire width of the front end. The claw 20 of the plate 19 is readily inserted into the claw inserting opening 2*c* of the container formed as described above, thereby raising the front end of the cover 2 as shown comparing FIGS. 3A and 3B. The surface of the plate 19 may be perforated or made porous to enlarge the surface area and thereby improve the cooling efficiency, or a fin of suitable shape may be formed on the plate 19. To circulate cold air, a flat fan may be mounted on the upper side of the plate 19. A capillary tube is arranged on the back surface side of a cooling plate mount 21 for holding the plate 19, and an evaporator connected with the capillary tube is contained in the plate 19. The plate 19 is preferably rotatable upwardly similarly to the rack 18 by rotatably providing the cooling plate mount 21 with respect to the walls 18 (FIG. 9). When the racks 18 and the plates 19 are constructed in this manner, the racks 18 and the plates 19 may be folded upwardly at nonuse time. Thus, the racks 18 and the plates 19 do not take a large space nor disturb any. A container having a large height may be applied by retention at every other rack 18 and plate 19. Remote switches 22, 23, 24 for setting cooling temperatures are disposed on the lateral front frames of the walls 17. The switches 22, 23, 24 correspond to the abovementioned pressors 8, 9, 10, respectively, and, for example, permit one to select freezing (−20° to −18° C.), chilling (−3° to +2° C.) and cooling (+5° to +10° C.). As will be described, two of the switches 22, 23, 24 are pressed by the two of the pressors 8, 9, 10 to thereby operate the refrigerating system.

Figure 11:
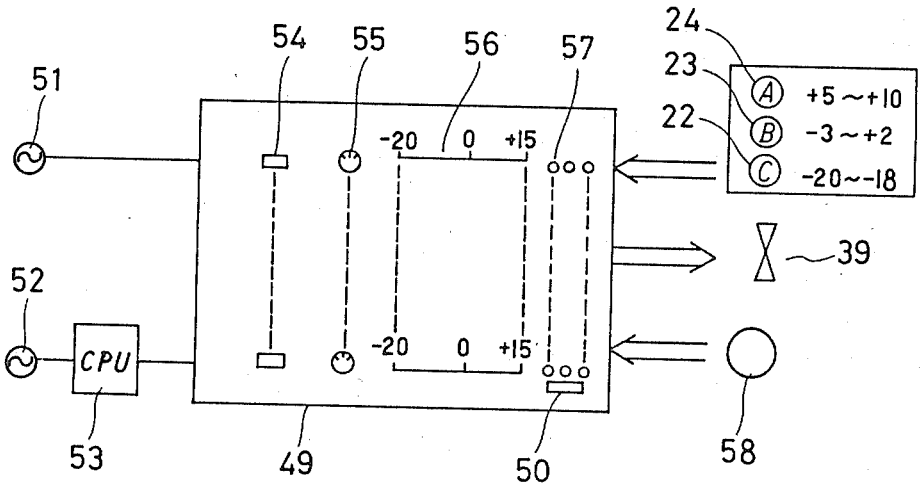
FIG. 11 is a schematic view of a refrigerating system controller.
Figure 12:
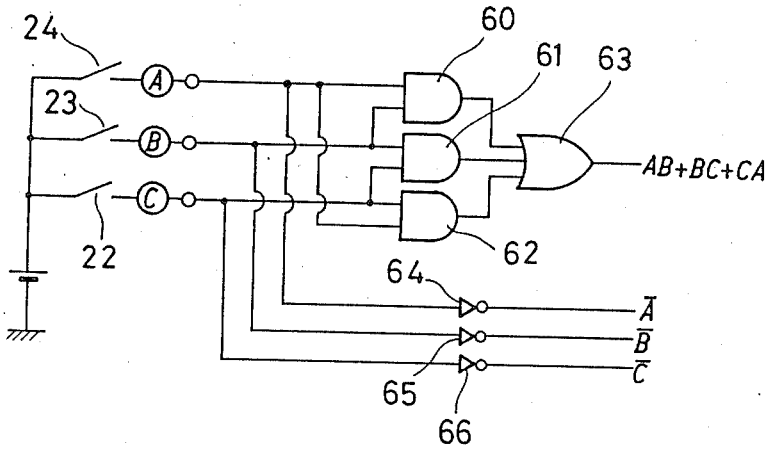
FIG. 12 is a circuit diagram of a logic circuit for the controller.

FIG. 11 schematically shows a controller of an insulating apparatus according to the invention. The controller has a control panel 49. A microprocessor 53 for variously controlling is contained in the panel 49. Power sources 51 and 52 of the panel 49 and the microprocessor 53 respectively have voltage converters for converting to DC 12 V, DC 24 V and AC 100 V available for both installed and portable types. A main/-remote changeover switch 54 of illumination type can preferably confirm the operating modes of the insulating apparatus. A main temperature control dial 55 is provided to individually regulate the temperatures of the containers. An indicator 56 indicates the temperatures or set temperatures of the containers. A temperature zone monitor 57 indicates the temperature zones of foods to be cooled. A power switch 50 switches the power sources of the entire insulating apparatus and the controller. Temperature zone set remote switches 22 to 24 supply contact signals and temperature sensors 58 made of thermistors supply temperature signals to the panel 49. Although the sensors 58 are indicated in summary, the number of the sensors 58 is the same as that of settable containers. The sensors 58 are integrated with the cooling plates 19, respectively or inserted individually into the respective containers 1. Though the solenoid valves 39 are indicated in summary, the same number of the valves 39 as that of the containers are provided to control the containers at the different temperatures (FIG. 10). FIG. 12 shows an example of a logic circuit for describing the manner for processing signals in the panel 49 when the remote switches 22 to 24 are closed upon depression by the pressors 8 to 10, respectively. More specifically, when any two of the switches 22 to 24 are pressed and operated by the two pressors which are not removed by 3 AND gates 60 to 62 and an OR gate 63, the OR gate 63 generates an output. The desired container from which the sole pressor is removed can be cooled by the output of the OR gate 63 and the outputs fed through inverters 64 to 66. Further, since the containers can be cooled by the operations of the two remote switches, there is no possibility of causing an erroneous operation.

Figure 13:
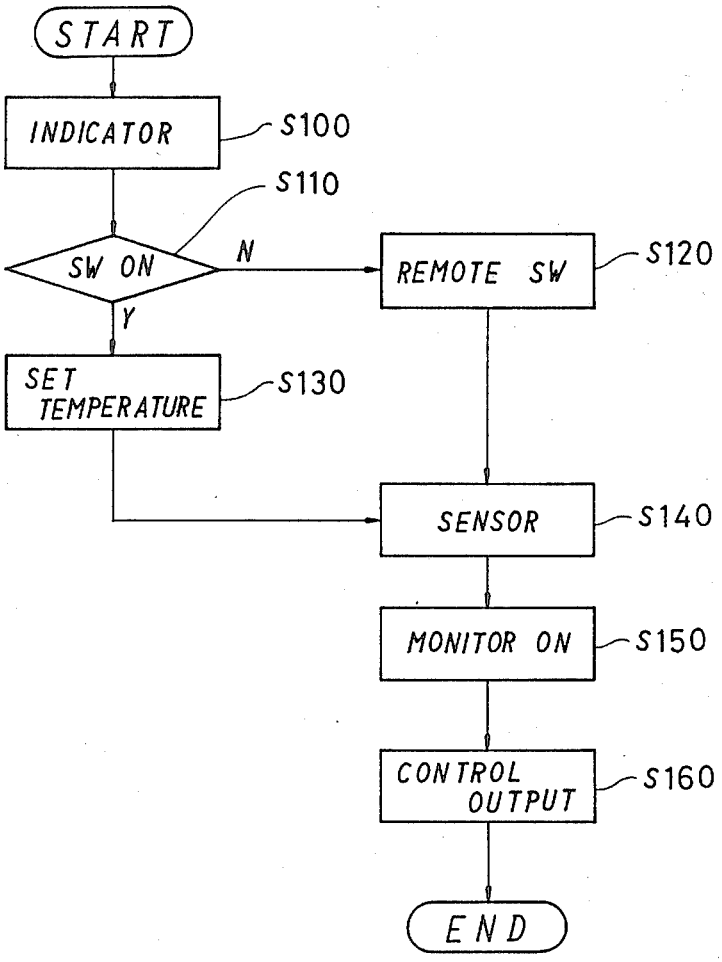
FIG. 13 is a flowchart showing the operating flow.

FIG. 13 is a flowchart showing the control flow of the insulating apparatus according to the invention. When the power switch 50 is turned ON in step S100, the indicator 56 is turned ON to indicate the power source ON. Then, the state of the switch 54 is confirmed in step S110, and when the switch 54 is set to the remote side, a control is advanced to step S120 to confirm the state of the remote switch. When the switch 54 is set to the main side, the set value by the main temperature control dial 55 is effected in step S130. When the insulating apparatus is controlled by the remote side of switch 54, a temperature zone monitor 57, displayed in colors in step S150, is turned ON by the operation of the sensor 58 in step S140, the temperature control output is generated in step S160, and the temperature is controlled by the operation of the solenoid valve 39. When the apparatus is controlled at the main side of the switch 54, the container can be cooled by the temperature set in step S130 irrespective of the state of the remote switch.

The insulating apparatus thus constructed of the invention is installed in a delivery center, a delivery branch store or a deck of a delivery vehicle, etc. To use the insulating apparatus, a delivery client places goods to be cooled in the container 1. In this case, dry ice and cold storage reagent are also contained together with the goods as required (ordinarily not required, but there might be the case that it takes a long time to deliver the goods to the branch store.) When the rubber strip 4 is engaged within the groove 3 after the cover 2 is applied on the container 1, the cover 2 is pressed downwardly by the strip 4, the front end 2*a* of the cover 2 is brought into contact with the step 1*a* of the container to close the front opening 5 of the container 1. The container 1 is brought into the branch store or the delivery center in this state, or delivered to the client. In this case, the cooling temperature is selected according to the type of the goods, i.e., freezing, chilling or cooling temperature is selected, and the corresponding pressor is removed (buried, and slid). Then, the client of the branch store or the delivery center sets the container 1 to the cooling unit 15 of the insulating apparatus. In this case, the rack 18 and the cooling plate 19 are tilted beforehand to a horizontal state (when the racks 18 and the cooling plates 19 are tiltably composed). Then, the front surface of the container 1 is directed toward the cooling unit 15 side, and pressed to slide on the rack 18. Thus, the claw 20 of the plate 19 is first introduced into the claw inserting opening 2*c*, the cover 2 is gradually pushed along the oblique surface of the claw 20 against the pushing force of the rubber strip 4, and the plate 19 itself is then introduced into the container 1 from the front opening 5. When the container 1 is pressed to the deepest position, either two of the pressors 8, 9, 10 collide with the corresponding remote switches to push them. Thus, the refrigerating system is operated, and the containers 1 start being cooled to the desired temperature range. When the temperatures of the containers 1 are regulated, the temperature controller is suitably operated. The containers 1 are ordinarily set from the rack 18 of the lowermost stage, but may be set at any stage. If the widths and the heights of the front openings 5 of the containers 1 are equalized, even if the lateral widths and the size are different, the containers 1 may be set in the same cooling unit 15. When the container 1 is drawn from the cooling unit to deliver the goods contained in the container 1, the pressing of the pressors 8, 9, 10 to the remote switches 22, 23, 24 is released to stop the operation of the refrigerating system of the cooling plate 19 which cools the container 1.

Figure 15:
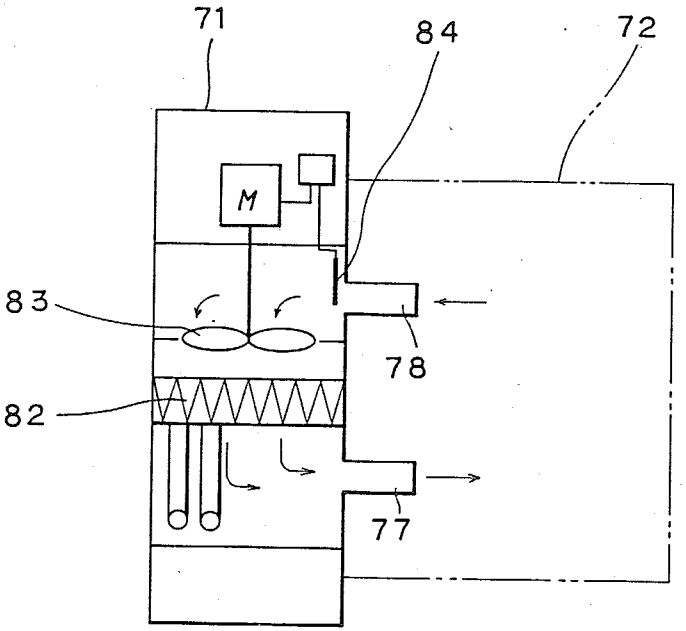
FIG. 15 is a view of the construction of a cooler of the case in FIG. 14.
Figure 14:
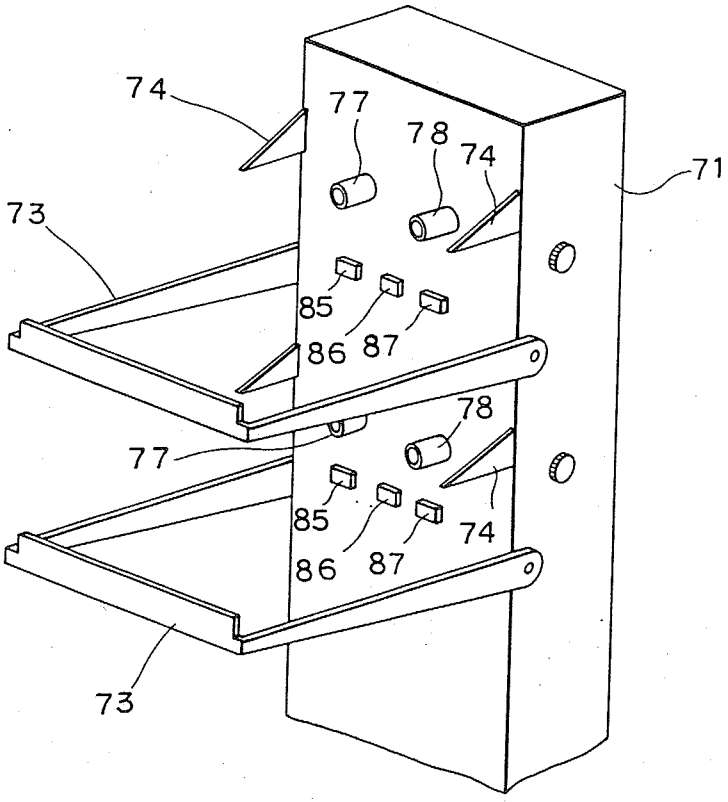
FIG. 14 is a perspective view showing the case of supplying a cold air into a container in a cooling type of the container.
Figure 16A:
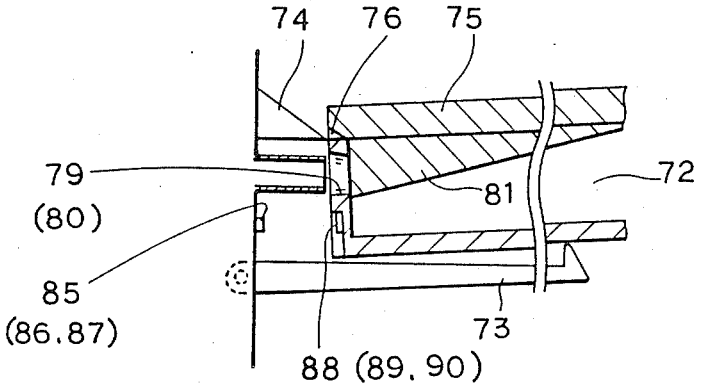
FIGS. 16A and 16B are views showing a method of inserting a supply conduit and a recovery conduit in the container.
Figure 16B:
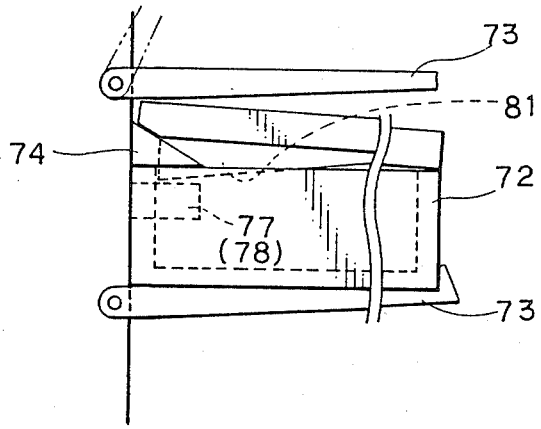

FIGS. 14 to 16A, 16B show the case that cooling air is supplied into the container from the cooling system in the container. In this case, a number of racks 73 which extend horizontally are provided in the cooling unit 71. A plurality of independent cooling units for individually cooling the containers 72 are contained in the cooling unit 71 as will be described later. Covering members 74 of wedge shape are provided at the right and left sides of the cooling unit 71 in the number corresponding to the number of the containers 72. The covering member 74 is introduced into the cutout 76 of wedge shape formed at the cover 75 of the container 72 when the container 72 is set on the rack 73 to raise upwardly the cover 75. A cooling air supply conduit 77 and a recovery conduit 78 are together projected from the cooling unit 71 toward the containers 72. The supply conduit 77 and the recovery conduit 78 are extended from the cooling system contained in the cooling unit 71 as shown in FIG. 15. Inserting openings 79 and 80, to which the conduits 77 and 78 are inserted, are opened at the sides of the container 72. The openings 79 and 80 are closed by blocking portions 81 formed integrally with the back surface side of the cover 75 when the cover 75 is closed, and opened by removing the blocking portions 81 from the conduits 77 and 78 when the cover 76 is opened to move the blocking portions 81 together with the cover 75 upwardly (in FIG. 16B). It is preferable to form the conduits 77 and 78 or the openings 79 and 80 in tapered shape to readily insert the conduits 77 and 78 into the openings 79 and 80. It is noted that caps may be mounted on the conduits 77 and 78 at nonusing time. FIG. 15 shows an example of the cooling system. The cooling system has an evaporator 82 and a fan 83 installed behind the evaporator 82. Cooling air generated by the evaporator 82 is forcibly supplied by the fan 83 into the supply conduit 77, and fed from the conduit 77 into the container 72. The recovery conduit 78 intakes the thermally exchanged cooling air in the container 72 by disposing the recovery conduit 78 behind the fan 83 to become negative pressure. More specifically, the cooling air is forcibly circulated in the cooling system and the container 72. Temperature sensors 84 are installed at the recovery conduit 78 side to detect the temperatures in the containers 72 and regulate the cooling degree. Referring back to FIG. 14, remote switches 85 to 87 and pressors 88 to 90 are provided to operate similarly to the remote switches 22 to 24 and the pressors 8 to 10 in the abovementioned previous embodiment.

Various modifications and alternations of this invention will be apparent to those skilled in the art without departing from the scope and spirit of this invention and the latter should not be restricted to that set forth herein for illustrative purposes.

What is claimed is:

1. An insulating apparatus comprising a plurality of cooling units each having an insulating container, a rack for holding said container and cooling means inserted into said container, selectively operable pressors provided at the front of said container, said cooling unit having remote switches for setting the cooling temperature at the settings corresponding to the pressors, said pressors operating the remote switches when the container is set on the rack to automatically individually cool the containers at predetermined temperatures.

2. The insulating apparatus as defined in claim 1, wherein said cooling means is a cooling plate containing an evaporator.

3. The insulating apparatus as defined in claim 1, wherein said cooling means is a cooling air supply conduit.

4. The insulating apparatus as defined in claim 1, wherein said pressor is a removable projecting piece.

5. The insulating apparatus as defined in claim 1, wherein said pressor is formed by burying a filling member in a recess.

6. The insulating apparatus as defined in claim 1, wherein said pressor is a slidable slide member.

7. The insulating apparatus as defined in claim 1, wherein the number of said pressors is 1 to 5.

8. The insulating apparatus as defined in claim 1, wherein the cooling temperature can be finely regulated.

9. The insulating apparatus as defined in claim 2, wherein said racks and cooling plates are tiltably pivoted upwardly.

* * * * *